US010556763B2

(12) United States Patent
Taoka

(10) Patent No.: US 10,556,763 B2
(45) Date of Patent: Feb. 11, 2020

(54) SHEET FEEDING APPARATUS AND AN IMAGE FORMING APPARATUS

(71) Applicant: CANON KABUSHIKI KAISHA, Tokyo (JP)

(72) Inventor: Keitaro Taoka, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/589,101

(22) Filed: May 8, 2017

(65) Prior Publication Data

US 2017/0320686 A1 Nov. 9, 2017

(30) Foreign Application Priority Data

May 9, 2016 (JP) ..... 2016-093788

(51) Int. Cl.
*B65H 3/06* (2006.01)
*G03G 15/00* (2006.01)

(52) U.S. Cl.
CPC ..... *B65H 3/0684* (2013.01); *G03G 15/6529* (2013.01); *B65H 2402/31* (2013.01); *B65H 2402/441* (2013.01); *B65H 2404/1521* (2013.01); *B65H 2405/11162* (2013.01); *B65H 2801/06* (2013.01)

(58) Field of Classification Search
CPC ..... B65H 3/0684; B65H 2402/441; B65H 2404/1521; B65H 2402/31; B65H 2405/11162
See application file for complete search history.

(56) References Cited

U.S. PATENT DOCUMENTS 7,156,389 B2 * 1/2007 Kadowaki ..... B65H 3/0684 271/117
7,971,866 B2 * 7/2011 Huang ..... H04N 1/0057 271/127
8,041,286 B2 10/2011 Won
(Continued)

FOREIGN PATENT DOCUMENTS

CN 101196710 A 6/2008
JP 2003-089433 A 3/2003
(Continued)

OTHER PUBLICATIONS

Dec. 11, 2018 Chinese Official Action in Chinese Patent Appln. No. 201710306370.1.

*Primary Examiner* — Howard J Sanders
(74) *Attorney, Agent, or Firm* — Venable LLP

(57) ABSTRACT

Disclosed is a sheet feeding apparatus including a tray unit capable of stacking a sheet at an opened position; a feeding member which feeds the sheet stacked on the tray unit; a feed supporting portion which supports the feeding member such that the feeding member is capable of moving to a feeding position for feeding the sheet stacked on the tray unit and to a storage position at which the feeding member is stored in the apparatus main body; and an urging portion which urges the feeding member toward the feeding position, wherein the feed supporting portion includes an abutting portion which abuts against a region other than a sheet stacking region of the tray unit for moving the feed supporting portion and for moving the feeding member to the storage position when the tray unit moves from the opened position to the closed position.

6 Claims, 8 Drawing Sheets

(56) References Cited

U.S. PATENT DOCUMENTS

| | | | | |
|---|---|---|---|---|
| 8,870,178 | B2 | 10/2014 | Taoka et al. | |
| 9,126,781 | B2 | 9/2015 | Aoyama | |
| 9,302,862 | B2 | 4/2016 | Taoka | |
| 9,487,363 | B2 | 11/2016 | Aoyama | |
| 2003/0052956 | A1 | 3/2003 | Katsuyama | |
| 2007/0222143 | A1 | 9/2007 | Murayama et al. | |
| 2008/0136080 | A1 | 6/2008 | Won | |
| 2012/0074636 | A1* | 3/2012 | Choi ..... | B65H 1/04 271/3.18 |
| 2014/0183813 | A1 | 7/2014 | Aoyama | |
| 2015/0321863 | A1 | 11/2015 | Aoyama | |

FOREIGN PATENT DOCUMENTS

| | | | |
|---|---|---|---|
| JP | 2006-062763 | A | 3/2006 |
| JP | 2014-125333 | A | 7/2014 |

* cited by examiner 19
3
4
90
18
10
91
91a

SHEET FEEDING APPARATUS AND AN IMAGE FORMING APPARATUS

BACKGROUND OF THE INVENTION

Field of the Invention

The present invention relates to a sheet feeding apparatus applicable to an image forming apparatus such as a printer and a copying machine and also relates to an image forming apparatus having the sheet feeding apparatus.

Description of the Related Art

In an image forming apparatus such as a printer and a copying machine, a sheet stacking tray which stacks sheets and a feeding mechanism which feeds the stacked sheets are provided. An image is formed on the sheets by feeding the sheets stacked on the sheet stacking tray one by one to an image forming portion at a predetermined timing.

Such a sheet feeding apparatus generally has a pickup roller for picking up a sheet, a conveying roller which conveys the sheet picked up by the pickup roller and a separation roller which separates a sheet from a plurality of sheet conveyed by the pickup operation.

In the sheet feeding apparatus which feeds sheets from the sheet stacking tray as described above, the sheet stacking tray protrudes from a side surface of the main body of the image forming apparatus. For this reason, the sheet stacking tray is usually attached to the apparatus main body so as to be capable of opening and closing with respect to the apparatus main body. In the closed state of the sheet stacking tray, the apparatus is configured such that the sheet stacking tray is substantially parallel to the side surface of the image forming apparatus or the sheet stacking tray is stored inside the exterior surface of the image forming apparatus.

However, in the configuration in which a pickup roller is used, since the pickup roller is supported by a supporting arm, this portion protrudes from a side surface of the apparatus main body. Therefore, the configuration has been proposed in which the supporting arm of the pickup roller is rotated in conjunction with the closing operation of the sheet stacking tray and the supporting arm is retreated in the stored state.

For example, in the configuration of Japanese patent Laid-Open application No. 2014-125333, when a sheet stacking tray is closed, the leading end of the supporting arm which supports the pickup roller abuts against the sheet stacking tray and is pushed up by the closing operation of the sheet stacking tray. In this configuration, when the sheet stacking tray is closed, the pickup roller moves to the storage position, so that this portion does not protrude from the side surface of the apparatus main body.

However, in the configuration of Japanese Patent Laid-Open Application No. 2014-125333, when the sheet stacking tray is closed, the leading end of the supporting arm which supports the pickup roller slides against the surface of the sheet stacking tray. Therefore, there is a problem that scratch marks are generated on the sheet stacking surface of the tray, and the appearance quality is lowered. In addition, scratch marks on the tray constituting a sheet stacking surface generate abrasive powder and there is a risk of sending the abrasive powder to the image forming portion by the sheet feeding operation.

In order to solve the above problem, Japanese Patent Laid-Open Application No. 2014-125333 discloses the configuration in which a rotating roller is attached to the tip of the supporting arm which slides against the tray, or the configuration in which the pickup roller abuts against the sheet stacking tray. However, in the configuration in which the roller is attached, although the contact load can be reduced, an occurrence of scratch marks cannot be completely avoided. Further, in the configuration in which the pickup roller abuts against the sheet stacking tray, since the pickup roller actively contacts the pickup roller which directly acts as a feeding function, anxiety of the scraping and the breakage of the pickup roller increases. Further, since the pickup roller is configured to abut against the stacking tray, it is not possible to avoid scratch marks on the stacking tray.

SUMMARY OF THE INVENTION

The present invention is intended to solve the above problems, and the present invention provides (1) a sheet feeding apparatus capable of suppressing the occurrence of scratch marks on a sheet stacking surface when a tray unit is closed, and (2) an image forming apparatus with the sheet feeding apparatus.

A sheet feeding apparatus according to the present invention comprises:

a tray unit configured to be capable of taking a closed position at which the tray unit is closed with respect to an apparatus main body and an opened position at which the tray unit is opened with respect to the apparatus main body, the tray unit having a sheet stacking surface on which a sheet is stacked at the opened position;

a feeding member configured to feed the sheet stacked on the tray unit;

a feed supporting portion configured to support the feeding member such that the feeding member is capable of moving to a feeding position for feeding the sheet stacked on the sheet stacking surface and to a storage position at which the feeding member is stored in the apparatus main body; and an urging portion configured to urge the feeding member toward the feeding position, wherein the feed supporting portion includes an abutting portion configured to abut against a region other than the sheet stacking surface of the tray unit for moving the feed supporting portion and for moving the feeding member to the storage position when the tray unit moves from the opened position to the closed position.

Further features of the present invention will become apparent from the following description of exemplary embodiments with reference to the attached drawings.

DESCRIPTION OF THE EMBODIMENTS

Next, embodiments of a sheet feeding apparatus according to the present invention will be explained together with an image forming apparatus including the sheet feeding apparatus.

First Embodiment

<Overall Configuration of the Image Forming Apparatus>

First of all, an overall configuration of an image forming apparatus equipped with a sheet feeding apparatus according to an embodiment of the present invention will be briefly explained.

Figure 1:
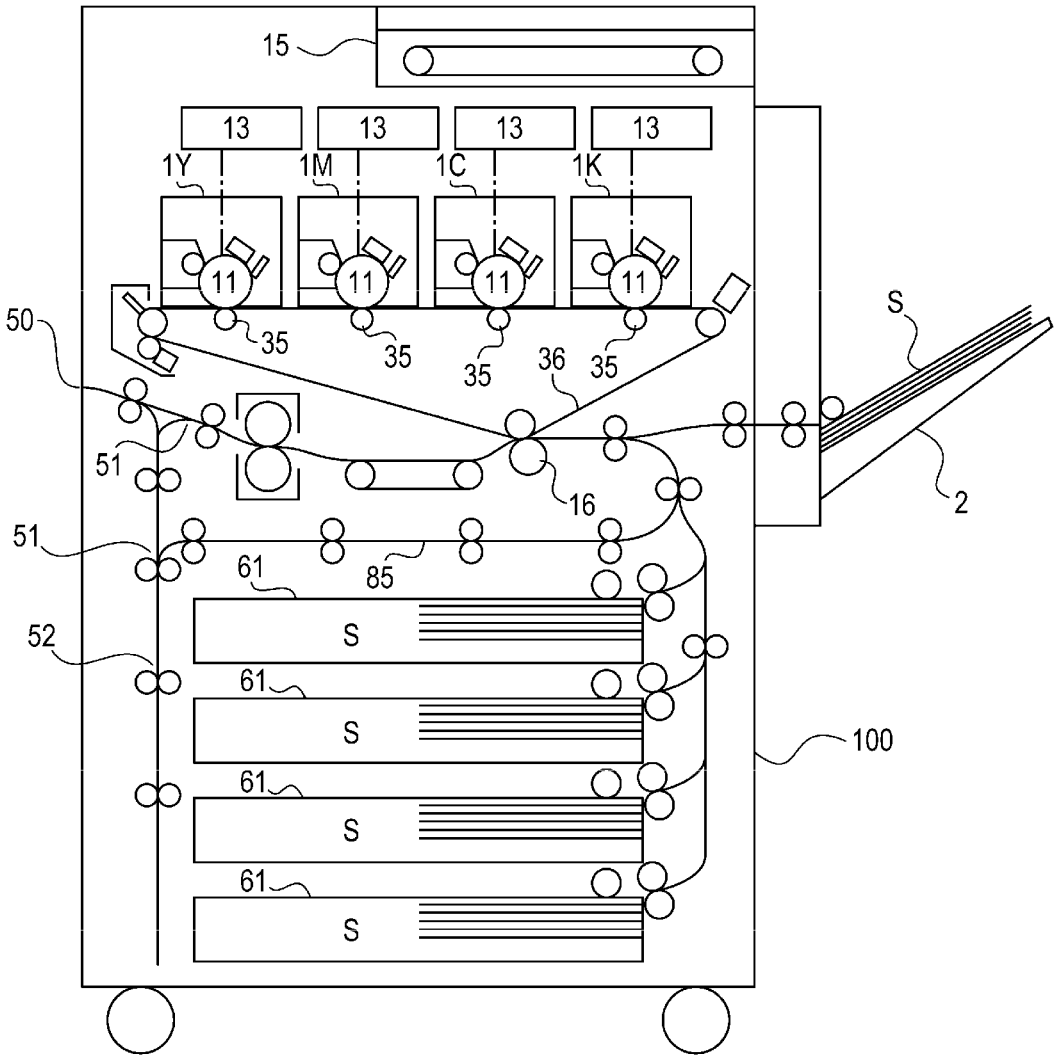
FIG. 1 is a schematic diagram showing a sectional view of an image forming apparatus.

The reader portion 15 having an optical scanning system for reading an image is provided at the upper portion of the apparatus main body 100 of the image forming apparatus in FIG. 1. The four image forming portions 1 (1Y, 1M, 1C and 1K) for forming respective color images of yellow (Y), magenta (M), cyan (C) and black (K) are provided below the reader portion 15. A full color image is formed by overlapping these color images.

On the lower portion of the apparatus main body 100, the front loading type sheet cassettes 61 are provided in multiple stages. Each of the front loading type sheet cassettes 61 accommodates sheets and is mounted so as to be removable from the front side of the apparatus. Further, on the right side of the apparatus main body 100 in FIG. 1, the manual feeding portion 2 of the type in which a sheet is set on a tray outside the apparatus main body 100 is provided.

The image forming portions 1 of the present embodiment are electro-photographic image forming portions, and each image forming portion has the same configuration except for the color of the toner. Upon image formation, the image information read by the reader portion 15 is photo-electrically converted by the scanner portion 13 and is transferred to the image forming portions 1 where respective toner images are formed on the photosensitive drums 11 in the image forming portions 1. The toner images on the photosensitive drums 11 are transferred to the intermediate transfer member 36 at the primary transfer portion 35 and are conveyed to the secondary transfer portion 16 by the intermediate transfer member 36. After the toner images are transferred to the sheet S sent by the conveying roller from the sheet cassettes 61 or from the manual feeding portion 2 at the secondary transfer portion 16, the sheet S is conveyed to the fixing device where heat and pressure are applied and the toner images are fused to the sheet S. Thereafter, when the one-side image formation mode is selected by a user, the sheet S is discharged to the outside of the apparatus from the discharging outlet 50. On the other hand, when the both-side image formation mode is selected by a user, the sheet S is conveyed to the secondary transfer unit 16 again via the reverse path 52 and the both side path 85 by the path switching portion 51.

<Sheet Feeding Apparatus>

Next, a sheet feeding apparatus which is a main configuration for the present invention will be explained with reference to FIGS. 2 and 3. Here, in the present embodiment, the sheet feeding apparatus will be explained by exemplifying the manual feeding portion 2.

Figure 2:
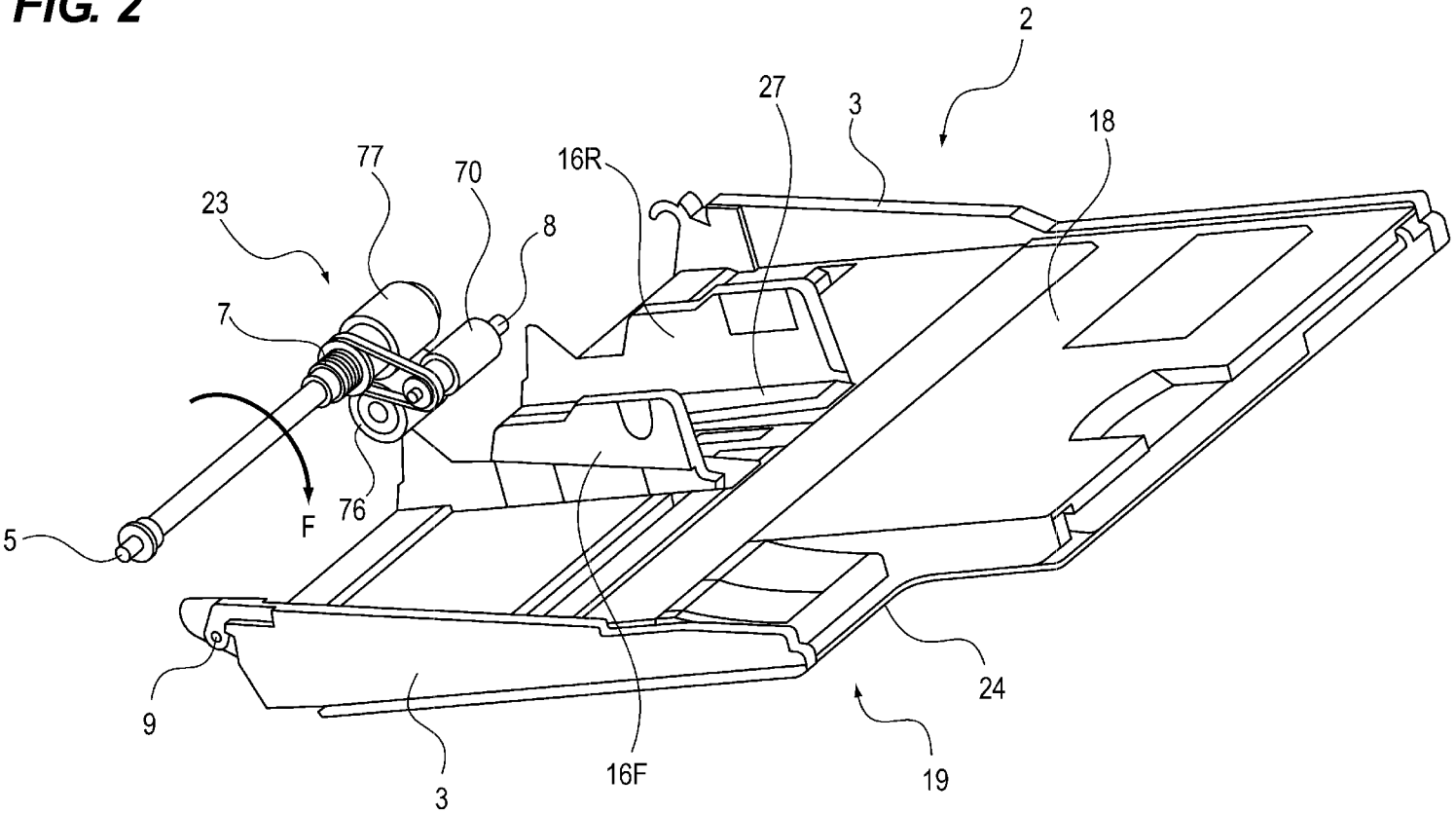
FIG. 2 is a diagram showing a perspective view of a sheet feeding apparatus according to the first embodiment.

FIG. 2 is a diagram showing a perspective view of a main configuration of the manual feeding portion 2. The manual feeding portion 2 includes the tray unit 19 having the sheet stacking tray 18 for stacking sheets, the side regulating members 16F and 16R which are adapted to the width position of the stacked sheets and the feeding portion 23 which feeds the sheets to the inside of the image forming apparatus. The sheet stacking tray 18 is provided with the slide groove 26 for engaging the side regulating members 16F and 16R. Due to this engagement of the slide groove 26 with the side regulating members 16F and 16R, the side regulating members 16F and 16R is configured to be slidable in the width direction in accordance with the width of the stacked sheets. The sheet stacking tray 18 has the sheet stacking surface 27 on which the sheets to be fed are stacked. The sheet stacking surface 27 is defined as an area covered by the maximum-sized sheet which can be fed from the manual feed portion 2, of the entire surface of the sheet stacking tray 18 on which the sheets are stacked.

The tray unit 19 includes the supported tray 24 which is supported at a position at which the supported tray 24 is opened with a predetermined angle with respect to the image forming apparatus main body 100 (not shown), and the sheet stacking tray 18 capable of stacking sheets S. The supported tray 24 is integrally provided with the tray arms 3 at both ends (front side and back side) in the sheet width direction which is orthogonal to the sheet feeding direction. A rotation hole 9 is provided on the base portion of the tray arm 3 and is configured to engage with a fixed shaft (not shown) of the image forming apparatus main body 100 so that the fixed shaft is rotatable about the rotation hole 9. As the tray unit 19 rotates about the rotation hole, the tray unit 19 is configured to be in the opened state where the sheets can be fed as shown in FIG. 1 and to be in the closed state where the tray unit 19 is substantially flush with a side surface of the apparatus main body 100.

The feeding portion 23 includes the pickup roller (feeding member) 70 for picking up the sheets stacked on the sheet stacking tray 18, the retard roller 76 for separating a single sheet from the picked-up sheets, and the conveying roller 77 for conveying the sheet.

Figure 3:
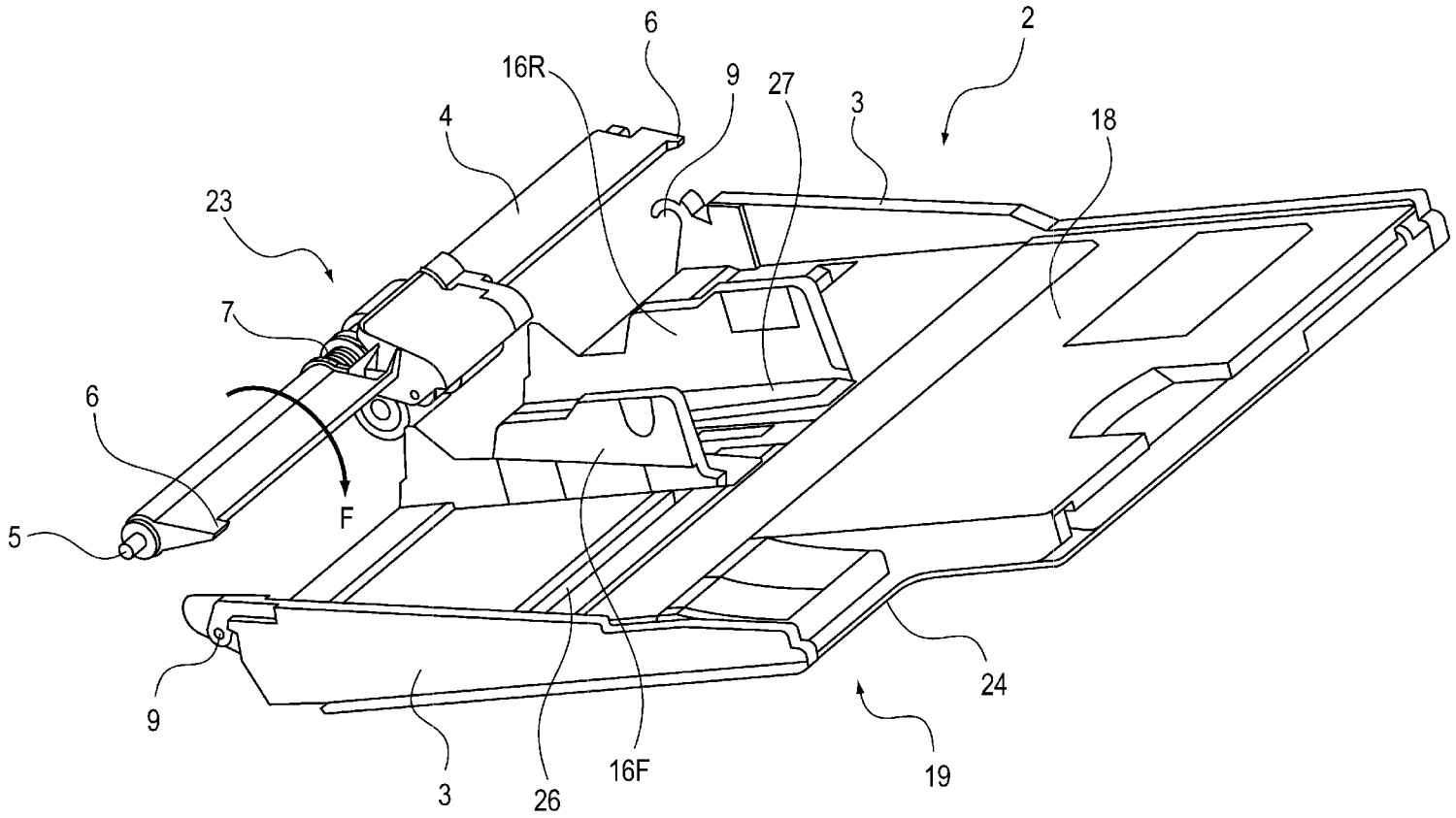
FIG. 3 is a diagram showing a roller holder which supports a pickup roller of the sheet feeding apparatus.

FIG. 3 is a diagram showing the roller holder (feed supporting portion) 4 for supporting the pickup roller 70 of the manual feeding portion 2 shown in FIG. 2. The pickup roller 70 is rotatably supported with respect to the roller shaft 8, and the roller shaft 8 is fixed to the roller holder 4. The roller holder 4 is attached so as to be rotatable with respect to the feeding portion 23 about the rotation shaft 5. The pickup roller 70 is urged to the direction (indicated by the arrow F in FIG. 3) in which the pickup roller 70 abuts against the sheets on the sheet stacking tray 18 by the pressure spring (urging portion) 7 formed of a torsion coil spring attached to the rotation shaft 5.

As a result, the pickup roller 70 can be moved to the feeding position for feeding the sheets stacked on the sheet stacking tray 18 and be moved to the standby position where the pickup roller 70 is separated from the sheets by being rotated upward from the feeding position.

<Relationship Between Tray Unit and Roller Holder>

When the manual feeder 2 according to the present embodiment is not used, it is closed by rotating the tray unit 19. In conjunction with this action, the roller holder 4 rotates and the pickup roller 70 is capable of moving to the storage position at which the pickup roller 70 is stored in the apparatus main body 100. As a result, the tray unit 19 can be closed without being obstructed by the pickup roller 70. Further, the tray unit 19 can be closed so as to be substantially flush with a side surface of the apparatus main body. Next, the configuration for this action will be explained.

As shown in FIG. 3, the roller holder 4 is provided with the end abutting portions 6 which protrude toward the upstream side in the sheet feeding direction at the both sides of the sheet width direction, that is, the front end portion and the back end portion in the longitudinal direction of the roller holder 4. The end abutting portions 6 are provided at positions opposed to the tray arms 3 provided at the front end portion and the back end portion of the supported tray 24.

Figures 4A, 4B, 4C, 4D:
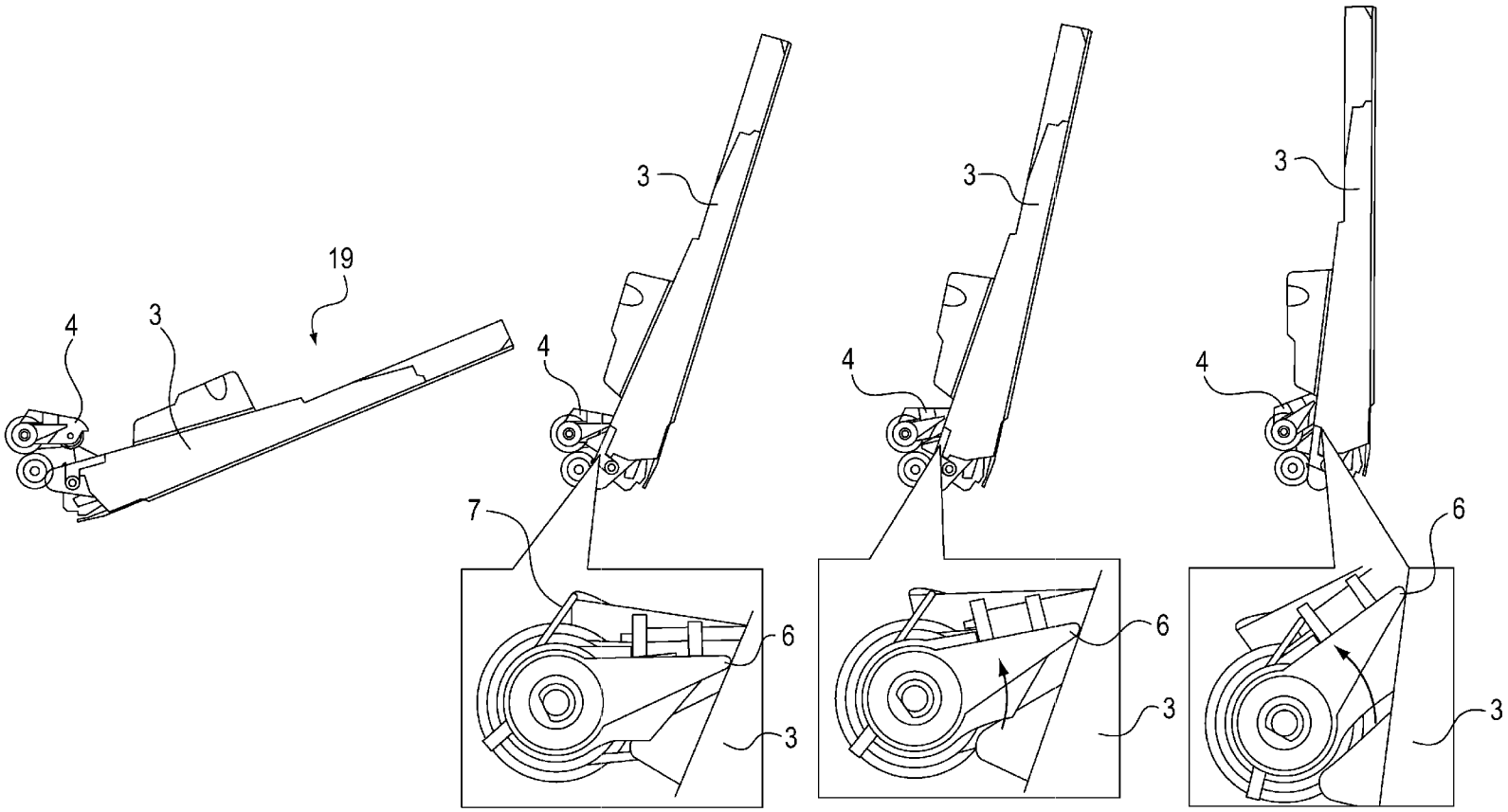
FIGS. 4A to 4D are diagrams showing processes of an operation of closing a tray unit by rotating it from the opened state.

FIGS. 4A to 4D are diagrams showing processes of an operation of closing the tray unit 19 by rotating it from the opened state. When the tray unit 19 is rotated in order to close the tray unit 19 from the opened state (FIG. 4A), the tray arm 3 abuts against the end abutting portion 6 formed on the roller holder 4 (FIG. 4B). When the tray unit 19 is subsequently further rotated, the tray arm 3 abuts the end abutting portion 6 so that the roller holder 4 is pushed up and the roller holder 4 rotates (FIG. 4C). When the tray unit 19 is completely closed with respect to the apparatus main body, the roller holder 4 also rotates with respect to the feeding portion 23 to be in the stored state (FIG. 4D). At this time, the pickup roller 70 moves to the storage position inside the apparatus main body.

Since the tray arm 3 is in a region other than the sheet stacking surface 27 (outside the sheet stacking region), by the configuration described above, when the tray unit 19 is closed, the pickup roller 70 can be stored in the apparatus main body without generating scratch marks on the sheet stacking surface 27.

Second Embodiment

Next, the configuration of the sheet feeding apparatus according to the second embodiment of the present invention will be explained with reference to FIGS. 5, 6A, 6B, 6C and 6D. Since the basic configuration of the apparatus of the present embodiment is the same as that of the above-described embodiment, a duplicate explanation will be omitted and the characteristic configuration of the present embodiment will be described here.

In the first embodiment, during the operation of closing the tray unit 19, the tray arm 3 abuts against the end abutting portions 6 formed at both end portions in the longitudinal direction of the roller holder 4 so that the roller holder rotates. In the present embodiment, the abutting state between the roller holder 4 and the tray unit 19 when the tray unit is completely closed is different from that in the first embodiment.

As in the first embodiment, in the sheet feeding apparatus according to the present embodiment, the end abutting portions 6 which protrude toward the upstream side in the sheet feeding direction are provided at the positions which are the front end portion and the back end portion of the roller holder 4 and which are opposed to the tray arms 3. When the manual feeder 2 is not used, it is closed by the rotation of the tray unit 19. By rotating the roller holder 4 in conjunction with this action, the pickup roller 70 is capable of being moved to the storage position of the apparatus main body 100. This is the same as in the first embodiment (FIGS. 4A to 4D).

Figure 5:
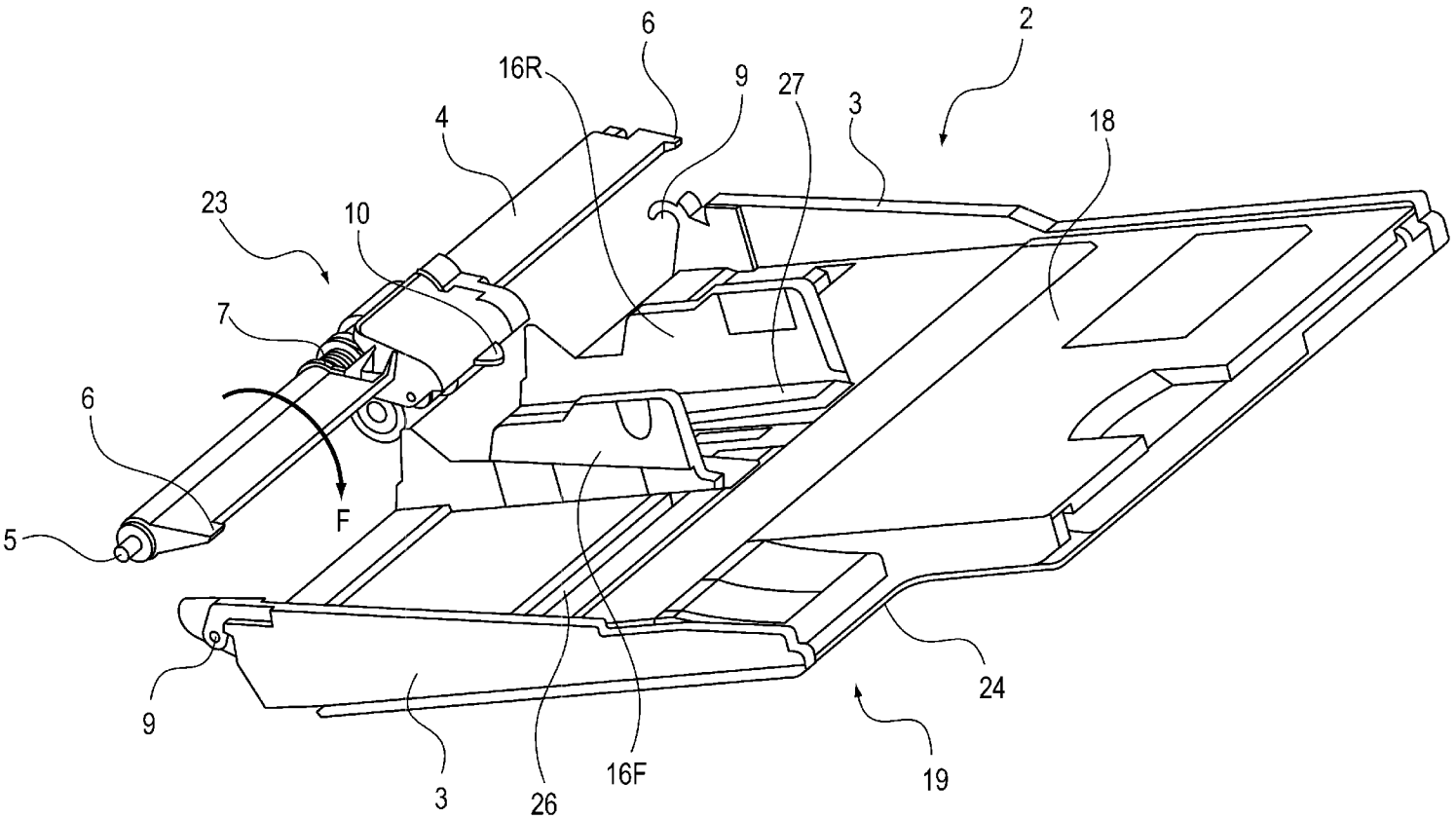
FIG. 5 is a diagram showing a perspective view of a sheet feeding apparatus according to the second embodiment.

In the present embodiment, the central abutting portion (second abutting portion) 10 is provided in the vicinity of the operating portion of the pressure spring 7 as shown in FIG. 5 in addition to the end abutting portions (first abutting portions) 6.

The operation of the end abutting portions 6 and the operation of the central abutting portion 10 when the tray unit 19 is rotated in order to close the tray unit 19 are explained with reference to the drawings. FIGS. 6A to 6D are diagrams showing cross-sectional views of the vicinity of the central abutting portion 10 in the processes of the operation of rotating the tray unit 19 in order to close it. The explanation of the operation of the central abutting portion 10 will be made with reference to FIGS. 6A to 6D. On the other hand, the operation of the end abutting portion 6 will be explained with reference to FIGS. 4A to 4D which are referenced when the first embodiment is explained.

Figures 6A, 6B, 6C, 6D:
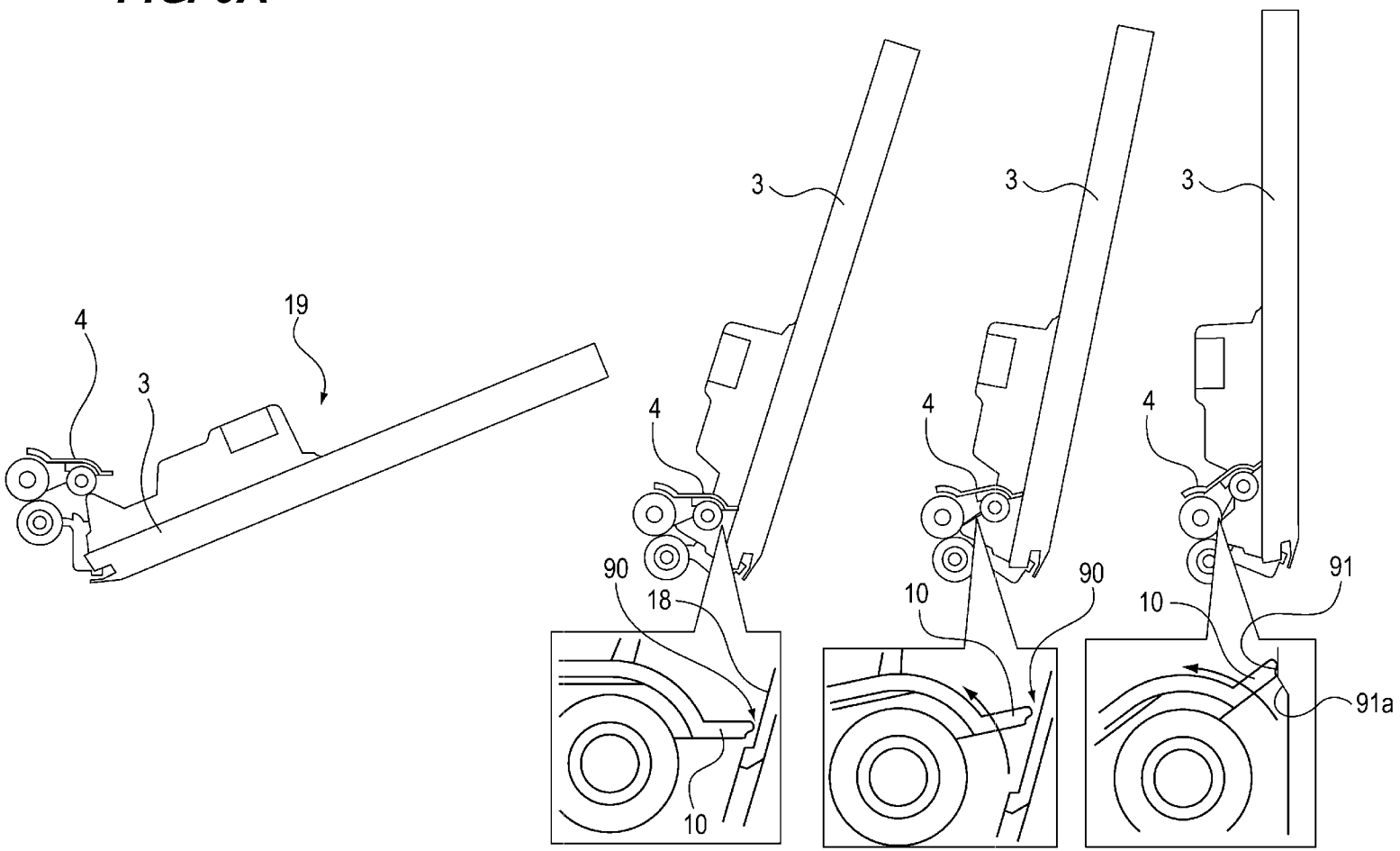
FIGS. 6A to 6D are diagrams for explaining an operation of a central abutting portion according to the second embodiment.

When the tray unit 19 is rotated in order to close the tray unit 19 from the opened state (FIG. 4A and FIG. 6A), the tray arm 3 abuts against the end abutting portion 6 of the roller holder 4 (FIG. 4B). At this time, the central abutting portion 10 of the roller holder 4 is separated from the sheet stacking tray 18 and the gap 90 is maintained (FIG. 6B).

When the tray unit 19 is subsequently further rotated, the tray arm 3 abuts against the end abutting portion 6 so that the roller holder 4 is pushed up and the roller holder 4 rotates (FIG. 4C). In the operation so far, the central abutting portion 10 is not in contact with the sheet stacking tray 18 and the gap 90 is maintained (FIG. 6C).

When the tray unit 19 is completely closed to be in the storage state, the central abutting portion 10 of the roller holder 4 abuts against the sheet stacking tray 18 (FIG. 6D) and the roller holder 4 enters the stored state (FIG. 4D). The protruding portion 91 for riding is formed at the position on the sheet stacking tray 18 which is opposed to the central abutting portion 10 in order that the central abutting portion 10 of the roller holder 4 is capable of abutting against the sheet stacking tray 18 in this stored state (FIG. 6D). In addition, the inclined portion 91*a* is formed on the protruding portion 91 so that the center abutting portion 10 can smoothly ride on the protruding portion 91.

When the central abutting portion 10 rides on the protruding portion 91, the roller holder 4 is supported by the sheet stacking tray 18 via the central abutting portion 10. Therefore, the urging force of the pressure spring 7 is received by the sheet stacking tray and the roller holder 4 is supported in the vicinity where the urging force of the pressure spring 7 acts.

With the above configuration, it is possible to retract the pickup roller 70 without generating scratch marks on the sheet stacking surface 27 by the operation of closing the tray unit 19 and to realize space saving of the apparatus. Further, the tray unit 19 abuts against the vicinity on the roller holder 4 where the urging force of the pressure spring 7 acts when the tray unit 19 is closed, thereby suppressing the deformation of the roller holder 4 caused by the spring force of the pressure spring 7.

Here, the expression "the vicinity where the urging force of the pressure spring 7 acts" means a region on the side of the pickup roller 70 from the end abutting portions 6 of the roller holder 4. With this measure of suppressing the deformation, the creep deformation of the roller holder 4 can be suppressed, which enables to form the roller holder 4 with an inexpensive resin member having low rigidity.

In the midst of the operation of closing the tray unit 19, the central abutting portion 10 does not abut against the tray unit 19 so that scratch marks are not generated. Further, since the central abutting portion 10 abuts against the protruding portion 91 for riding at the final stage of the operation of closing the tray unit 19, there is almost no possibility that the scratch marks are made.

In the present embodiment, when the tray unit 19 is closed and the pickup roller 70 is moved to the storage position, the central abutting portion 10 abuts against the protruding portion 91 of the tray unit 19. At this time, the apparatus can be configured that the end abutting portions 6 may be separated from the tray unit 19. This makes it possible to more reliably prevent the deformation of the roller holder 4.

Third Embodiment

Next, a sheet feeding apparatus according to the third embodiment will be explained with reference to FIGS. 7, 8A and 8B. In the present embodiment, the initial abutting state between the roller holder 4 and the tray unit 19 in the course of closing the tray unit 19 in the sheet feeding apparatus according to the above-explained second embodiment is different from that in the above-explained second embodiment.

Figure 7:
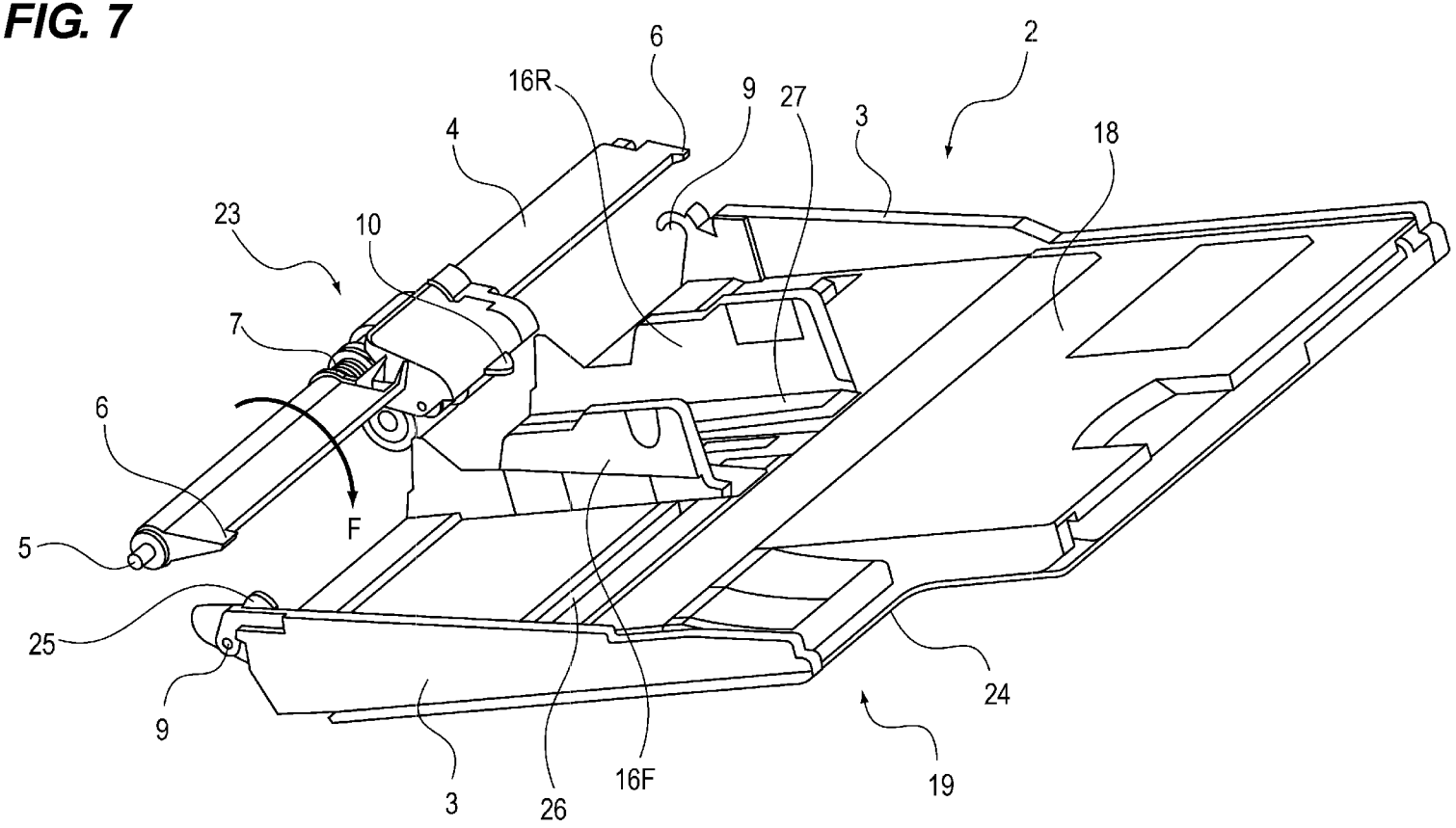
FIG. 7 is a diagram showing a perspective view of a sheet feeding apparatus according to the third embodiment.
Figure 8A:
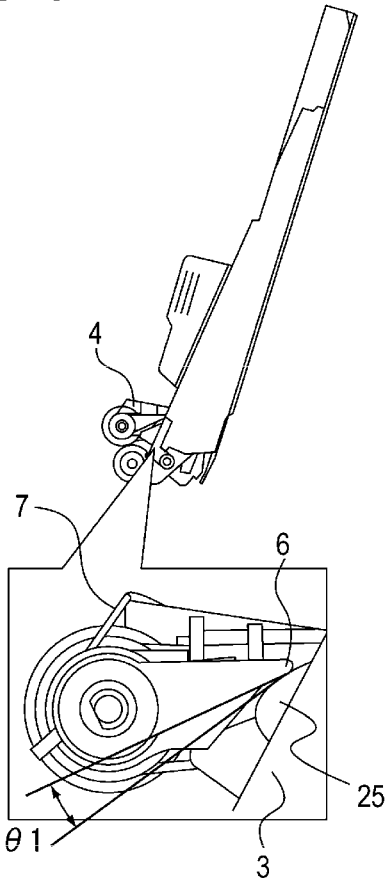
FIGS. 8A and 8B are diagrams showing processes of an operation of closing a tray unit according to the third embodiment by rotating it from the opened state.
Figure 8B:
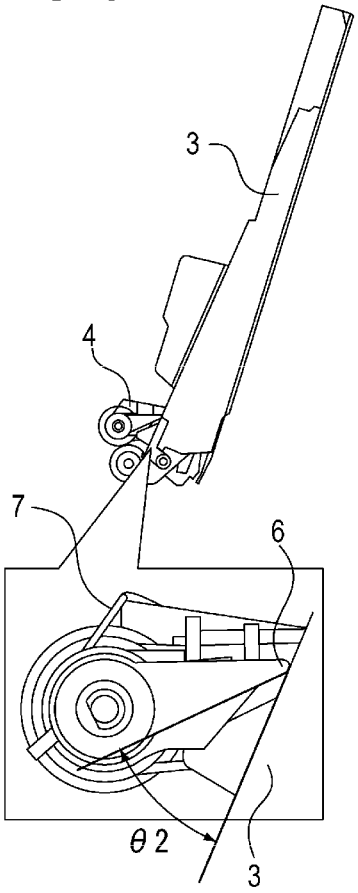

As shown in FIG. 7, in the sheet feeding device according to the present embodiment, the tray arm abutting portion 25, which is a protruding portion, is provided on the tray arm 3 on the front side against which the end abutting portion 6 on the front side abuts. Other parts of the configuration are the same as those of the second embodiment explained above.

When the manual feeder 2 is not used, the tray unit 19 is rotated from the opened state in order to close the tray unit 19. Then, the tray arm 3 abuts against the end abutting portion 6. The roller holder 4 is urged by the pressure spring 7 explained above. In the present embodiment, the pressure spring 7 is arranged on the front side of the center portion in the sheet width direction of the roller holder 4.

Therefore, the abutting force of the contact portion between the end abutting portion 6 provided at the front end in the longitudinal direction of the roller holder 4 and the tray arm 3 is different from that of the contact portion between the end abutting portion 6 provided at the back end in the longitudinal direction of the roller holder 4 and the tray arm 3. In the present embodiment, the abutting force at the front side end is larger than that at the back side end. Therefore, the contact portion at the front side end on which side the pressure spring 7 is disposed is liable to be worn away. Further, the portions of the tray arm 3 and the end abutting portion 6 on which the tray arm 3 and the end abutting portion 6 are firstly brought in contact are particularly liable to be worn away since an impact force at the first abutment is applied to the portions.

In order to suppress this problem, the tray arm 3 is provided with the tray arm abutting portion 25. The tray arm abutting portion 25 is formed in such a shape that the abutting angle θ1 between the end abutting portion 6 and the tray arm abutting portion 25 when the tray unit 19 is started to be closed, which is shown in FIG. 8A is less than the abutting angle θ2 between the end abutting portion 6 and the tray arm 3 in the absence of the tray arm abutting portion 25, which is shown in FIG. 8B. As a result, at the time when the tray unit 19 is started to be closed, the end abutting portion 6 abuts against the tray arm abutting portion 25 while the end abutting portion 6 lies on the tray arm abutting portion 25. By decreasing the abutting angle as described above, as shown in FIG. 8B, the abutting force which is applied at the beginning of the abutment in the case where the tray arm abutting portion 25 is provided (for example, 160 gf) can be reduced as compared with the abutting force in the case where the tray arm abutting portion 25 is not provided (for example, 260 gf), thereby reducing the abrasion.

The above explanation is illustrated assuming that the abutting force in the case where the tray arm abutting portion 25 is not provided is 260 gf, and the abutting force in the case where the tray arm abutting portion 25 is provided is 160 gf. However, these values may be changed according to the design of the spring force of the pressure spring 7 and the abutting position or the abutting angle between the end abutting portion 6 of the roller holder 4 and the tray arm 3, and the present invention is not limited to these values.

When the tray unit 19 is kept rotated in the closing direction, the abutment of the end abutting portion 6 with the tray arm abutting portion 25 transitions to the abutment of the end abutting portion 6 with the tray arm 3 where the abutting angle becomes larger than that in the case where the end abutting portion 6 abuts against the tray arm abutting portion 25. Then, the subsequent operation is the same as explained in the preceding embodiments.

As explained above, with the provision of the tray arm abutting portion 25 on the tray arm 3, abrasion of the tray arm 3 and the end abutting portion 6 of the roller holder 4 can be reduced by decreasing the abutting force on the portion of tray arm 3 against which the end abutting portion 6 of the roller holder 4 firstly abuts.

In the present embodiment, the tray arm abutting portion 25 is provided only on the tray arm 3 of the side where the pressure spring 7 is arranged with respect to the center in the longitudinal direction of the roller holder 4. However, the tray arm abutting portion 25 may be provided on the tray arm 3 of the side where the pressure spring 7 is not disposed.

Other Embodiments

In the embodiments explained above, the end abutting portions 6 are provided at the front end portion and the back end portion of the roller holder 4. However, the end abutting portion 6 may be provided on either the front end portion or the back end portion.

Further, in the above explained embodiments, the end abutting portion 6 abuts against the tray arm 3. However, the present invention is not limited to this configuration and a portion which abuts against the roller holder 4 may be provided outside the area of the sheet stacking surface of the tray. Further, the upper surfaces of the side regulating members 16F and 16R may abut against the roller holder 4. In this case, the apparatus is configured such that the abutting portions of the roller holder 4, which abut against the side regulating members 16F and 16R, should not be a sheet conveying surface.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2016-093788, filed May 9, 2016, which is hereby incorporated by reference herein in its entirety.

What is claimed is:

1. A sheet feeding apparatus, comprising:

a tray unit configured to be capable of moving to a closed position at which the tray unit is closed with respect to an apparatus main body and to an opened position at which the tray unit is opened with respect to the apparatus main body, the tray unit including (1) a sheet stacking tray on which a sheet is stacked and (2) tray arms disposed on both sides, in a direction perpendicular to a sheet conveying direction, of the sheet stacking tray, the tray arms having holes which are engaged with a shaft fixed to the apparatus main body, wherein the tray unit is configured to swing around the shaft engaged with the holes;

a pickup roller configured to feed the sheet stacked on the sheet stacking tray;

a roller holder rotatably provided on the apparatus main body, the roller holder being configured to support the pickup roller such that the pickup roller is capable of moving to a feeding position for feeding the sheet stacked on the sheet stacking tray and to a storage position at which the pickup roller is separated from the sheet stacking tray by being rotated upward from the feeding position; and a pressure spring configured to urge the pickup roller toward the feeding position, wherein the roller holder includes an abutting portion, which is provided on at least one end portion of the roller holder, the abutting portion being configured not to abut any of the tray arms when the tray unit stays at the opened position and the pickup roller is positioned at the feeding position and to abut against at least one of the tray arms when the tray unit moves from the opened position to the closed position such that the pickup roller is moved to the storage position.

2. The sheet feeding apparatus according to claim 1, wherein the abutting portion comprises:

a first abutting portion provided on at least one end portion of the roller holder in a sheet width direction orthogonal to a sheet feeding direction, the first abutting portion being configured to abut against the tray unit when the tray unit moves from the opened position to the closed position; and a second abutting portion configured to abut against the tray unit in a vicinity in which an urging force of the pressure spring acts when the tray unit has moved to the closed position.

3. The sheet feeding apparatus according to claim 2, wherein the first abutting portion is separated from the tray unit in a state where the pickup roller has moved to the storage position.

4. The sheet feeding apparatus according to claim 1, further comprising a protruding portion against which the abutting portion abuts when the tray unit moves from the opened position to the closed position, the protruding portion being configured such that an abutting angle between the protruding portion and the abutting portion is less than an abutting angle between the tray unit and the abutting portion in a case where the protruding portion is not provided.

5. The sheet feeding apparatus according to claim 1, wherein the tray unit includes a regulating member, which is provided movably in a sheet width direction, the regulating member being configured to regulate an end portion of the stacked sheet in the sheet width direction, and wherein the abutting portion abuts against the regulating member to move the roller holder and the roller holder moves the pickup roller to the storage position when the tray unit moves from the opened position to the closed position.

6. An image forming apparatus which forms an image on a sheet fed by a sheet feeding apparatus, the sheet feeding apparatus comprising:

a tray unit configured to be capable of swinging to a closed position at which the tray unit is closed with respect to an apparatus main body and to an opened position at which the tray unit is opened with respect to the apparatus main body, the tray unit including (1) a sheet stacking tray on which a sheet is stacked and (2) tray arms disposed on both sides, in a direction perpendicular to a sheet conveying direction, of the sheet stacking tray, the tray arms having holes which are engaged with a shaft fixed to the apparatus main body, wherein the tray unit is configured to swing around the shaft engaged with the holes;

a pickup roller configured to feed the sheet stacked on the sheet stacking tray;

a roller holder rotatably provided on the apparatus main body, the roller holder being configured to support the pickup roller such that the pickup roller is capable of moving to a feeding position for feeding the sheet stacked on the sheet stacking tray and to a storage position at which the pickup roller is separated from the sheet stacking tray by being rotated upward from the feeding position; and a pressure spring configured to urge the pickup roller toward the feeding position, wherein the roller holder includes an abutting portion, which is provided on at least one end portion of the roller holder, the abutting portion being configured not to abut any of the tray arms when the tray unit stays at the opened position and the pickup roller is positioned at the feeding position and to abut against at least one of the tray arms when the tray unit moves from the opened position to the closed position such that the pickup roller is moved to the storage position.

* * * * *